US011715406B2

(12) United States Patent
Park et al.

(10) Patent No.: US 11,715,406 B2
(45) Date of Patent: Aug. 1, 2023

(54) DISPLAY DEVICE AND DRIVING METHOD OF THE SAME

(71) Applicant: Samsung Display Co., LTD., Yongin-si (KR)

(72) Inventors: Se Hyuk Park, Yongin-si (KR); Jin Young Roh, Yongin-si (KR); Woo Mi Bae, Yongin-si (KR); Hae Kwan Seo, Yongin-si (KR); Young Ha Sohn, Yongin-si (KR); Jin Wook Yang, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/706,519

(22) Filed: Mar. 28, 2022

(65) Prior Publication Data

US 2023/0018362 A1 Jan. 19, 2023

(30) Foreign Application Priority Data

Jul. 16, 2021 (KR) ..... 10-2021-0093242

(51) Int. Cl.
*G09G 3/20* (2006.01)

(52) U.S. Cl.
CPC ... *G09G 3/2003* (2013.01); *G09G 2300/0452* (2013.01); *G09G 2300/0819* (2013.01); *G09G 2300/0842* (2013.01); *G09G 2310/0297* (2013.01); *G09G 2310/08* (2013.01); *G09G 2330/023* (2013.01)

(58) Field of Classification Search
CPC ..... G09G 3/2003; G09G 2300/0452; G09G 2300/0819; G09G 2300/0842; G09G 2310/0297; G09G 2310/08; G09G 2330/023
See application file for complete search history.

(56) References Cited

U.S. PATENT DOCUMENTS 6,614,498 B1 9/2003 Tanaka et al.
9,870,749 B2 1/2018 Yoo et al.
10,839,754 B2 11/2020 Kim et al.
(Continued)

FOREIGN PATENT DOCUMENTS

JP 3636192 4/2005
KR 10-2016-0033289 3/2016
(Continued)

*Primary Examiner* — Kenneth Bukowski
(74) *Attorney, Agent, or Firm* — H.C. Park & Associates, PLC

(57) ABSTRACT

A display device includes: a data driver for supplying a data signal to output lines; a demultiplexer connected to each of the output lines, the demultiplexer to supply the data signal supplied to each output line to a first data line and a second data line; first pixels disposed in a (2j−1)-th column and a (2k−1)-th row, the first pixels being connected to the first data line, wherein j and k are positive integers; second pixels disposed in the (2j−1)-th column and a (2k)-th row, the second pixels being connected to the second data line; third pixels disposed in a (2j)-th column and the (2k−1)-th row, the third pixels being connected to the first data line; and fourth pixels disposed in the (2j)-th column and the (2k)-th row, the fourth pixels being connected to the second data line.

15 Claims, 10 Drawing Sheets

(56) References Cited

U.S. PATENT DOCUMENTS

| | | | | |
|---|---|---|---|---|
| 2005/0212446 | A1* | 9/2005 | Eom | G09G 3/3233 315/169.3 |
| 2007/0097072 | A1* | 5/2007 | Kim | G09G 3/3614 345/103 |
| 2012/0092241 | A1* | 4/2012 | Shang | G09G 3/3648 345/87 |
| 2016/0078826 | A1* | 3/2016 | Yoo | G09G 3/3648 345/88 |
| 2016/0225318 | A1* | 8/2016 | Choi | G09G 3/3258 |
| 2017/0249914 | A1* | 8/2017 | Kim | G09G 3/3607 |
| 2017/0345357 | A1* | 11/2017 | Kong | G09G 3/2003 |
| 2017/0365206 | A1* | 12/2017 | Kim | G09G 3/20 |
| 2018/0157134 | A1* | 6/2018 | Lee | G02F 1/1368 |
| 2019/0073931 | A1* | 3/2019 | Kim | G01R 31/44 |

FOREIGN PATENT DOCUMENTS

| | | |
|---|---|---|
| KR | 10-2016-0129246 | 11/2016 |
| KR | 10-2019-0030067 | 3/2019 |

* cited by examiner

PXC1: PX11, PX21, PX31, PX41
PXC2: PX12, PX22, PX32, PX42
PXC3: PX13, PX23, PX33, PX43
PXC4: PX14, PX24, PX34, PX44
PXC5: PX15, PX25, PX35, PX45
PXC6: PX16, PX26, PX36, PX46
PXC7: PX17, PX27, PX37, PX47
PXC8: PX18, PX28, PX38, PX48

PXC1: PX11, PX21, PX31, PX41
PXC2: PX12, PX22, PX32, PX42
PXC3: PX13, PX23, PX33, PX43
PXC4: PX14, PX24, PX34, PX44

PXC1: PX11, PX21, PX31, PX41
PXC2: PX12, PX22, PX32, PX42
PXC3: PX13, PX23, PX33, PX43
PXC4: PX14, PX24, PX34, PX44

PXC1: PX11, PX21, PX31, PX41
PXC2: PX12, PX22, PX32, PX42
PXC3: PX13, PX23, PX33, PX43
PXC4: PX14, PX24, PX34, PX44

PXC1: PX11, PX21, PX31, PX41
PXC2: PX12, PX22, PX32, PX42
PXC3: PX13, PX23, PX33, PX43
PXC4: PX14, PX24, PX34, PX44

DISPLAY DEVICE AND DRIVING METHOD OF THE SAME

CROSS-REFERENCE TO RELATED APPLICATION

This application claims priority from and the benefit of Korean patent application 10-2021-0093242, filed on Jul. 16, 2021, which is hereby incorporated by reference for all purposes as if fully set forth herein.

BACKGROUND

Field

Embodiments of the invention relate generally to a display device and a method of the driving the same and, more particularly, to a display device having a demultiplexer and a method of driving the display device.

Discussion of the Background

As information technologies have been developed, a display device as a connection medium between a user and information has become more important. Accordingly, display devices such as a liquid crystal display device and an organic light emitting display device are widely used.

In general, a display device includes a data driver for supplying a data signal to data lines, a scan driver for supplying a scan signal to scan lines, and a plurality of pixels connected to the data lines and the scan lines.

Conventionally, there has been proposed a structure in which a demultiplexer is added to output lines of a data driver so as to reduce manufacturing cost. The demultiplexer may receive a data signal input through the output lines of the data driver, and time-divisionally output a data signal to data lines of which number is greater than that of the output lines.

The above information disclosed in this Background section is only for understanding of the background of the inventive concepts, and, therefore, it may contain information that does not constitute prior art.

SUMMARY

Display devices and the methods of driving the same in accordance with the principles and illustrative embodiments of the invention are capable of changing the connection relationship between pixels and data lines disposed in a display panel, e.g., by using one or more multiplexers, to reduce power consumption. For example, display devices constructed in accordance with the principles and illustrative embodiments of the invention may include a structure connected to a data line through an opening provided in a pixel. Thus, when a red image is displayed on the display panel, the number of times that a data signal output from a demultiplexer is toggled (e.g., the number of times that the turn-on and turn-off levels of the data signal output from the demultiplexer are changed) can be decreased, and power consumption can be reduced.

Additional features of the inventive concepts will be set forth in the description which follows, and in part will be apparent from the description, or may be learned by practice of the inventive concepts.

According to one aspect of the invention, a display device includes: a data driver to supply a data signal to output lines; a demultiplexer connected to each of the output lines, the demultiplexer to supply the data signal supplied to each output line to a first data line and a second data line; first pixels disposed in a (2j−1)-th column and a (2k−1)-th row, the first pixels being connected to the first data line, wherein j and k are positive integers; second pixels disposed in the (2j−1)-th column and a (2k)-th row, the second pixels being connected to the second data line; third pixels disposed in a (2j)-th column and the (2k−1)-th row, the third pixels being connected to the first data line; and fourth pixels disposed in the (2j)-th column and the (2k)-th row, the fourth pixels being connected to the second data line.

The first pixels may be supplied with the data signal when a scan signal is supplied to a scan line disposed in the (2k−1)-th row, and the third pixels may be supplied with the data signal when a scan signal is supplied to a scan line disposed in a (k−1)-th row.

The second pixels may be supplied with the data signal when a scan signal is supplied to a scan line disposed in the (2k)-th row, and the fourth pixels may be supplied with the data signal when a scan signal is supplied to the scan line disposed in the (2k−1)-th row.

The demultiplexer may include: a first transistor connected between the output line and the first data line; and a second transistor connected between the output line and the second data line.

The display device may further include a timing controller to supply a second control signal to the first transistor and supply a first control signal to the second transistor.

The timing controller may supply the first control signal and the second control signal such that the second transistor and the first transistor are sequentially turned on.

The first pixels may emit a first color light, the second pixels may emit a second color light, and the third pixels and the fourth pixels may emit a third color light.

The first pixels may be directly connected to the first data line, and the third pixels may be connected to the first data line via a second opening.

The second pixels may be connected to the second data line via a third opening, and the fourth pixels may be directly connected to the second data line.

The first pixels and the third pixels may be directly connected to the first data line.

The second pixels may be connected to the second data line via a third opening, and the fourth pixels may be directly connected to the second data line.

The second pixels and the fourth pixels may be directly connected to the second data line.

The display device may further include: fifth pixels disposed in the (2j−1)-th column and a (k+2)-th row, the fifth pixels being connected to the first data line; sixth pixels disposed in the (2j−1)-th column and a (k+3)-th row, the sixth pixels being connected to the second data line; seventh pixels disposed in the (2j)-th column and the (k+2)-th row, the seventh pixels being connected to the first data line; and eighth pixels disposed in the (2j)-th column and the (k+3)-th row, the eighth pixels being connected to the second data line.

The fifth pixels may be supplied with the data signal when a scan signal is supplied to a scan line disposed in the (k+2)-th row, and the seventh pixels may be supplied with the data signal when a scan signal is supplied to the scan line disposed in the (2k)-th row.

The sixth pixels may be supplied with the data signal when a scan signal is supplied to a scan line disposed in the (k+3)-th row, and the eighth pixels may be supplied with the data signal when a scan signal is supplied to the scan line disposed in the (k+2)-th row.

The fifth pixels and the seventh pixels may be directly connected to the first data line.

The sixth pixels may be connected to the second data line via a third opening (e.g., a third via hole or a third contact hole), and the eighth pixels may be directly connected to the second data line.

According to one aspect of the invention, a method of driving a display device includes a data driver, a demultiplexer, first pixels, second pixels, third pixels, and fourth pixels, wherein the first pixels are disposed in a (2j−1)-th column and a (2k−1)-th row, and connected to the first data line, wherein j and k are positive integers, the second pixels are disposed in the (2j−1)-th column and a (2k)-th row, and are connected to the second data line, the third pixels are disposed in a (2j)-th column and the (2k−1)-th row, and are connected to the first data line, and the fourth pixels are disposed in the (2j)-th column and the (2k)-th row, and are connected to the second data line, the method includes: supplying a data signal to output lines; and supplying the data signal supplied to the output line to a first data line and a second data line.

The first pixels may be supplied with the data signal when a scan signal is supplied to a scan line disposed in the (2k−1)-th row, and the third pixels may be supplied with the data signal when a scan signal is supplied to a scan line disposed in a (k−1)-th row.

The second pixels may be supplied with the data signal when a scan signal is supplied to a scan line disposed in the (2k)-th row, and the fourth pixels may be supplied with the data signal when a scan signal is supplied to the scan line disposed in the (2k−1)-th row.

The step of supplying the data signal to output the lines may be performed by the data driver; and the step of supplying the data signal supplied to the output line to the first data line and the second data line may be performed by the demultiplexer connected to each of the output lines.

It is to be understood that both the foregoing general description and the following detailed description are illustrative and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate illustrative embodiments of the invention, and together with the description serve to explain the inventive concepts.

DETAILED DESCRIPTION

Figure 1:
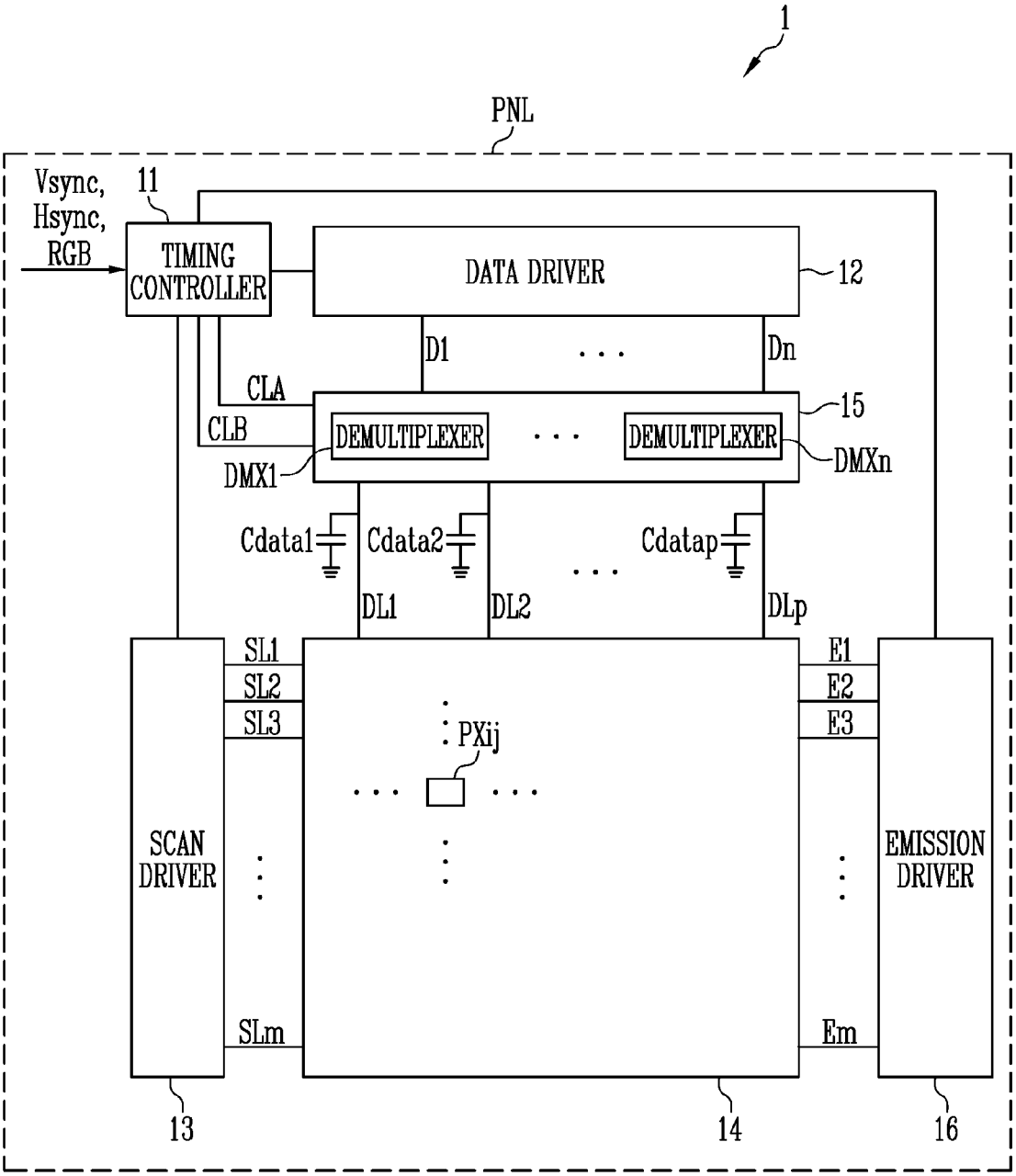
FIG. 1 is a block diagram of an embodiment of a display device constructed according to the principles of the invention.

In the following description, for the purposes of explanation, numerous specific details are set forth in order to provide a thorough understanding of various embodiments or implementations of the invention. As used herein "embodiments" and "implementations" are interchangeable words that are non-limiting examples of devices or methods employing one or more of the inventive concepts disclosed herein. It is apparent, however, that various embodiments may be practiced without these specific details or with one or more equivalent arrangements. In other instances, well-known structures and devices are shown in block diagram form in order to avoid unnecessarily obscuring various embodiments. Further, various embodiments may be different, but do not have to be exclusive. For example, specific shapes, configurations, and characteristics of an embodiment may be used or implemented in another embodiment without departing from the inventive concepts.

Unless otherwise specified, the illustrated embodiments are to be understood as providing illustrative features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an embodiment may be implemented differently, a specific process order may be performed differently from the described order. For example, two consecutively described operating processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. Further, the D1-axis, the D2-axis, and the D3-axis are not limited to three axes of a rectangular coordinate system, such as the x, y, and z-axes, and may be interpreted in a broader sense. For example, the D1-axis, the D2-axis, and the D3-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

As customary in the field, some embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some embodiments may be physically separated into two or more interacting and discrete blocks, units, and/or modules without departing from the scope of the inventive concepts. Further, the blocks, units, and/or modules of some embodiments may be physically combined into more complex blocks, units, and/or modules without departing from the scope of the inventive concepts.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

FIG. 1 is a block diagram of an embodiment of a display device constructed according to the principles of the invention.

Referring to FIG. 1, the display device 1 may include a display panel PNL including a timing controller 11, a data driver 12, a scan driver 13, a pixel unit 14, a demultiplexer circuit 15, and an emission driver 16.

In an embodiment, the display panel PNL may include at least some components among the timing controller 11, the data driver 12, the scan driver 13, the demultiplexer circuit 15, and the emission driver 16.

The timing controller 11 may receive an external input signal from an external processor. The external input signal may include a vertical synchronization signal Vsync, a horizontal synchronization signal Hsync, a data enable signal, RGB data RGB, and the like. The timing controller 11 may apply a control signal to the demultiplexer circuit 15 through a first control line CLA and a second control line CLB. The timing controller 11 may control the output of a data signal to data lines DL1 to DLp by using the control signal applied to the demultiplexer circuit 15.

The vertical synchronization signal Vsync may include a plurality of pulses, and indicate that a previous frame period is ended and a current frame period is started with respect to a time at which each of the pulses is generated. An interval between adjacent pulses of the vertical synchronization signal Vsync may correspond to one frame period. The horizontal synchronization signal Hsync may include a plurality of pulses, and indicate that a previous horizontal period is ended and a new horizontal period is started with respect to a time at which each of the pulses is generated. An interval between adjacent pulses of the horizontal synchronization signal Hsync may correspond to one horizontal period. The data enable signal may indicate that RGB data is supplied in a horizontal period. The RGB data may be supplied in units of pixel rows in horizontal periods, corresponding to the data enable signal. RGB data corresponding to one frame may be referred to as one input image.

The data driver 12 may provide pixels with data signals (e.g., data voltages) corresponding to grayscales of an input image. For example, the data driver 12 may sample or obtain grayscales of the data signals by using a clock signal. The data driver 12 may apply data signals corresponding to the sampled grayscales to output lines D1 to Dn. Here, n may be a positive integer.

The scan driver 13 may receive a clock signal, a scan start signal, and the like from the timing controller 11, and generate scan signals to be provided to the scan lines SL1 to SLm.

The pixel unit 14 may include pixels PXij. Each pixel PXij may be connected to a corresponding data line among the data lines DL1 to DLp and a corresponding scan line among the scan lines SL1 to SLm. Here, i and j may be positive integers. In addition, p may be an integer greater than n, and m may be a positive integer. For example, p may be set to an integer multiple of n.

The demultiplexer circuit 15 may include n demultiplexers DMX1, DMX2, . . . , and DMXn. In other words, the demultiplexer circuit 15 may include demultiplexers DMX1, DMX2, . . . , and DMXn of which number is equal to that of the output lines D1 to Dn. Each of the demultiplexers DMX1, DMX2, . . . , and DMXn may be connected to any one of the output lines D1 to Dn. Also, each of the demultiplexers DMX1, DMX2, . . . , and DMXn is connected to the data lines DL1 to DLp. For example, each of the demultiplexers DMX1, DMX2, . . . , and DMXn may be connected to two data lines. The demultiplexers DMX1, DMX2, . . . , and DMXn may supply a data signal to p data lines.

When each data signal supplied to the output lines D1 to Dn by using the demultiplexers DMX1, DMX2, . . . , and DMXn is supplied to a plurality of data lines, the number of output lines included in the data driver 12 may decrease. In addition, the number of data integrated circuits included in the data driver 12 may also decrease. Data signals supplied to one output line are supplied to a plurality of data lines by using the demultiplexers DMX1, DMX2, . . . , and DMXn, so that manufacturing cost can be reduced.

The emission driver 16 may receive a clock signal, an emission stop signal, and the like from the timing controller 11, and generate emission control signals to be provided to emission control lines E1 to Em.

Each pixel PXij may further include a transistor connected to a corresponding emission control line among the emission control lines E1 to Em. The transistor may be turned off during a data write period of each pixel PXij, to prevent light emission of the pixel PXij. Data capacitors Cdata1, Cdata2, . . . , and Cdatap may be respectively connected to the data lines DL1 to DLp. The data capacitors Cdata1, Cdata2, . . . , and Cdatap may temporarily store a data signal supplied to the data lines DL1 to DLp, and supply the stored data signal to the pixel PXij. Parasitic capacitors equivalently formed in the data lines DL1 to DLp may be used as the data capacitors Cdata1, Cdata2, . . . , and Cdatap. In addition, external capacitors may be additionally connected to the data lines DL1 to DLp to be used as the data capacitors Cdata1, Cdata2, . . . , and Cdatap, respectively.

Figure 2:
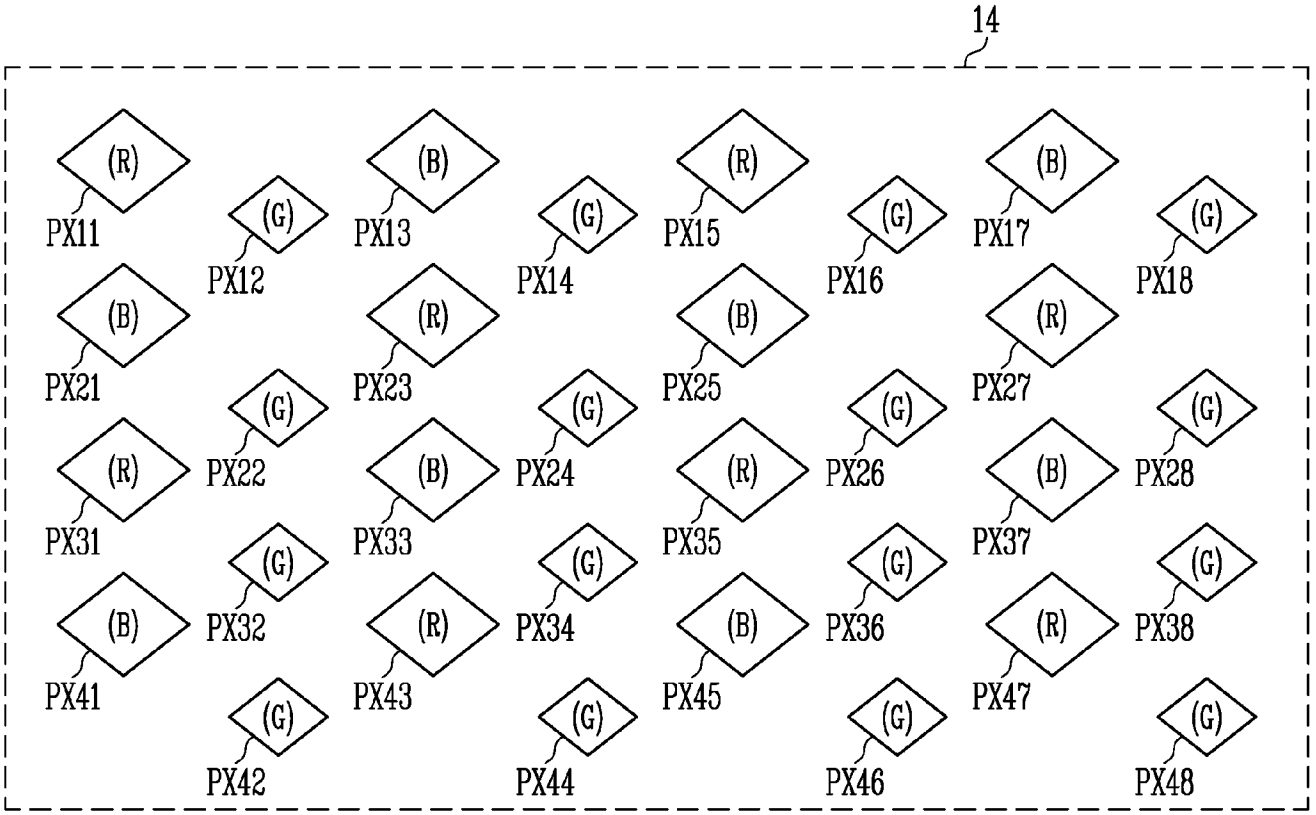
FIG. 2 is a schematic view of an example of a pixel unit provided in the display device of FIG. 1.

FIG. 2 is a schematic view of an example of the pixel unit provided in the display device of FIG. 1.

Referring to FIG. 2, a pixel unit 14 having a PENTILE™ structure is exemplarily illustrated. The pixel unit 14 may include a plurality of pixels. For example, the pixel unit 14 may include a first pixel column PXC1 disposed in a first column, a second pixel column PXC2 disposed in a second column, a third pixel column PXC3 disposed in a third column, a fourth pixel column PXC4 disposed in a fourth column, a fifth pixel column PXC5 disposed in a fifth column, a sixth pixel column PXC6 disposed in a sixth column, a seventh pixel column PXC7 disposed in a seventh column, and an eighth pixel column PXC8 disposed in an eighth column. Although the first to eighth pixel columns PXC1, PXC2, PXC3, PXC4, PXC5, PXC6, PXC7, and PXC8 have been illustrated in FIG. 2, embodiments are not limited thereto, and the pixel unit 14 may include a larger number of pixel columns. For example, the number of the pixel columns may be varied.

The first pixel column PXC1 may include a red pixel PX11, a blue pixel PX21, a red pixel PX31, and a blue pixel PX41. For example, red pixels PX11 and PX31 (R) and blue pixels PX21 and PX41 (B) may be alternately disposed on the first pixel column PXC1.

The second pixel column PXC2 may include a green pixel PX12, a green pixel PX22, a green pixel PX32, and a green pixel PX42. For example, a plurality of green pixels PX12, PX22, PX32, and PX42 (G) may be disposed on the second pixel column PXC2.

The third pixel column PXC3 may include a blue pixel PX13, a green pixel PX23, a blue pixel PX33, and a red pixel PX43. For example, blue pixels PX13 and PX33 (B) and red pixels PX23 and PX43 (R) may be alternately disposed on the third pixel column PXC3. For example, when the blue pixel PX13 (B) is disposed on a first row of the third pixel column PXC3, the red pixel PX11 (R) may be disposed on the first row of the first pixel column PXC1.

The fourth pixel column PXC4 may include a green pixel PX14, a green pixel PX24, a green pixel PX34, and a green pixel PX44. For example, a plurality of green pixels PX14, PX24, PX34, and PX44 (G) may be disposed on the fourth pixel column PXC4.

The fifth pixel column PXC5 may include a red pixel PX15, a blue pixel PX25, a red pixel PX35, and a blue pixel PX45. The seventh pixel column PXC7 may include a blue pixel PX17, a red pixel PX27, a blue pixel PX37, and a red pixel PX47. For example, like the first pixel column PXC1, red pixels PX15 and PX35 (R) and blue pixels PX25 and PX45 (B) may be alternately disposed on the fifth pixel column PXC5. Like the third pixel column PXC3, blue pixels PX17 and PX37 (B) and red pixels PX27 and PX47 (R) may be alternately disposed on the seventh pixel column PXC7.

The sixth pixel column PXC6 may include a green pixel PX16, a green pixel PX26, a green pixel PX36, and a green pixel PX46. The eighth pixel column PXC8 may include a green pixel PX18, a green pixel PX28, a green pixel PX38, and a green pixel PX48. For example, like the second pixel column PXC2 and the fourth pixel column PXC4, a plurality of green pixels PX16, PX26, PX36, PX46, PX18, PX28, PX38, and PX48 may be disposed on the sixth pixel column PXC6 and the eighth pixel column PXC8.

Figure 3:
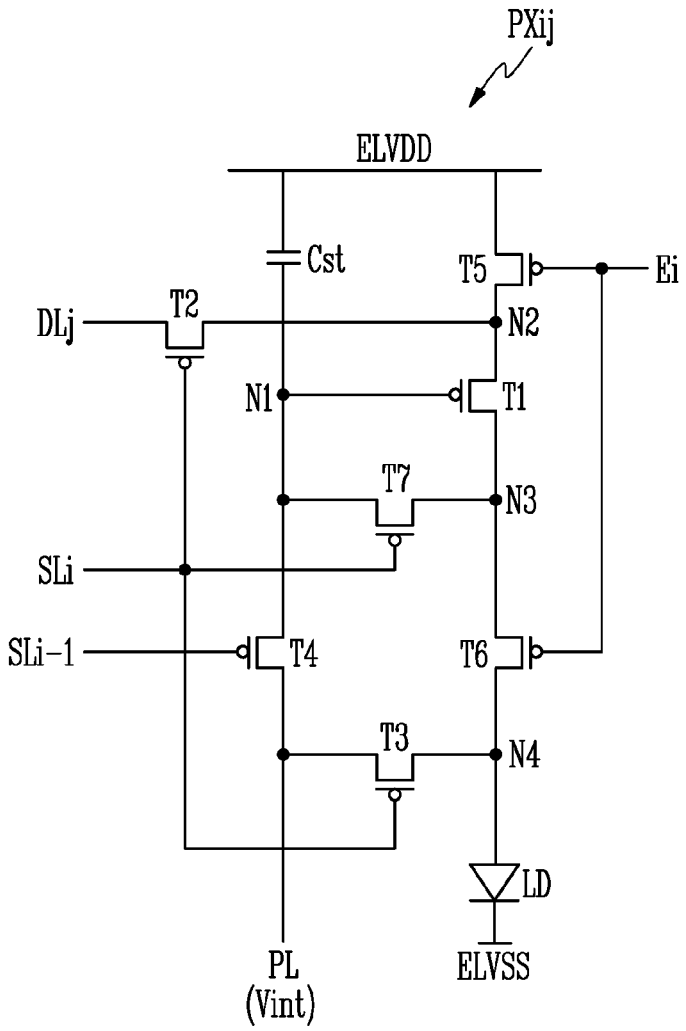
FIG. 3 is a schematic view of a representative pixel provided in the display device of FIG. 1.

FIG. 3 is a schematic view of an example of the pixel provided in the display device of FIG. 1.

For convenience of description, a pixel which is located on an i-th horizontal line and is connected to a j-th data line DLj will be illustrated in FIG. 3.

Referring to FIG. 3, the pixel PXij provided in the display device 1 may include a light emitting element LD, transistors T1 to T7, and a storage capacitor Cst. The pixel PXij is not limited to the structure show in FIG. 3, and may have various structures. Hereinafter, it is assumed that the pixel PXij has the structure shown in FIG. 3.

A first electrode (e.g., an anode electrode or a cathode electrode) of the light emitting element LD may be connected to a fourth node N4, and a second electrode (e.g., a cathode electrode or an anode electrode) of the light emitting element LD may be connected to a second driving power line ELVSS. The light emitting element LD generates light with a predetermined luminance, corresponding to an amount of current supplied from a first transistor T1.

In an embodiment, the light emitting element LD may be an organic light emitting diode including an organic emitting layer. In another embodiment, the light emitting element LD may be an inorganic light emitting element. For example, the inorganic light emitting element may be formed of an inorganic material. Alternatively, the light emitting element LD may have a form in which inorganic light emitting elements are connected in parallel and/or series between the second driving power line ELVSS and the fourth node N4.

A first electrode of the first transistor T1 (e.g., driving transistor) may be connected to a second node N2, and a second electrode of the first transistor T1 may be connected to a third node N3. A gate electrode of the first transistor T1 may be connected to a first node N1. The first transistor T1 may control a driving current flowing from a first driving power line ELVDD to the second driving power line ELVSS via the light emitting element LD, corresponding to a voltage of the first node N1. The first driving power line ELVDD may have a voltage higher than that of the second driving power line ELVSS.

A second transistor T2 may be connected between the j-th data line DLj and the second node N2. A gate electrode of the second transistor T2 may be connected to an i-th scan line SLi. The second transistor T2 may be turned on by a gate-on level of a scan signal supplied to the i-th scan line SLi, to electrically connect the j-th data line DLj and the second node N2 to each other.

A third transistor T3 may be connected between the first electrode of the light emitting element LD (e.g., the fourth node N4) and a power line PL through which an initialization voltage Vint is supplied. A gate electrode of the third transistor T3 may be connected to the i-th scan line SLi. The third transistor T3 may be turned on by the gate-on level of the scan signal supplied to the i-th scan line SLi, to supply the initialization voltage Vint to the first electrode of the light emitting element LD (e.g., the fourth node N4).

A fourth transistor T4 may be connected between the first node N1 and the power line PL. A gate electrode of the fourth transistor T4 may be turned on by a gate-on level of a scan signal supplied to an (i−1)-th scan line SLi−1, to supply the initialization voltage Vint to the first node N1.

A fifth transistor T5 may be connected between the first driving power line ELVDD and the second node N2. A gate electrode of the fifth transistor T5 may be connected to an i-th emission control line Ei. The fifth transistor T5 may be turned on by a gate-on level of an emission control signal supplied to the i-th emission control line Ei.

A sixth transistor T6 may be connected between the second electrode of the first transistor T1 (e.g., the third node N3) and the first electrode of the light emitting element LD (e.g., the fourth node N4). A gate electrode of the sixth transistor T6 may be connected to the i-th emission control line Ei. The sixth transistor T6 may be turned on by the gate-on level of the emission control signal supplied to the i-th emission control line Ei. Therefore, the fifth transistor T5 and the sixth transistor T6 may be simultaneously controlled.

A seventh transistor T7 may be connected between the second electrode of the first transistor T1 (e.g., the third node N3) and the first node N1. A gate electrode of the seventh transistor T7 may be connected to the i-th scan line SLi. The seventh transistor T7 may be turned on by the gate-on level of the scan signal supplied to the i-th scan line SLi, to electrically connect the second electrode of the first transistor T1 and the first node N1 to each other. When the seventh transistor T7 is turned on, the first transistor T1 may be connected in a diode form.

The storage capacitor Cst may be connected between the first driving power line ELVDD and the first node N1.

Additionally, the scan line, to which the transistors T2, T3, T4, and T7 are connected, may be variously changed or modified. In an example, the fourth transistor T4 may be driven by being connected to a separate scan line instead of the (i−1)-th scan line SLi−1. Similarly, the third transistor T3 may also be driven by being connected to a separate scan line instead of the i-th scan line Si.

Figure 4:
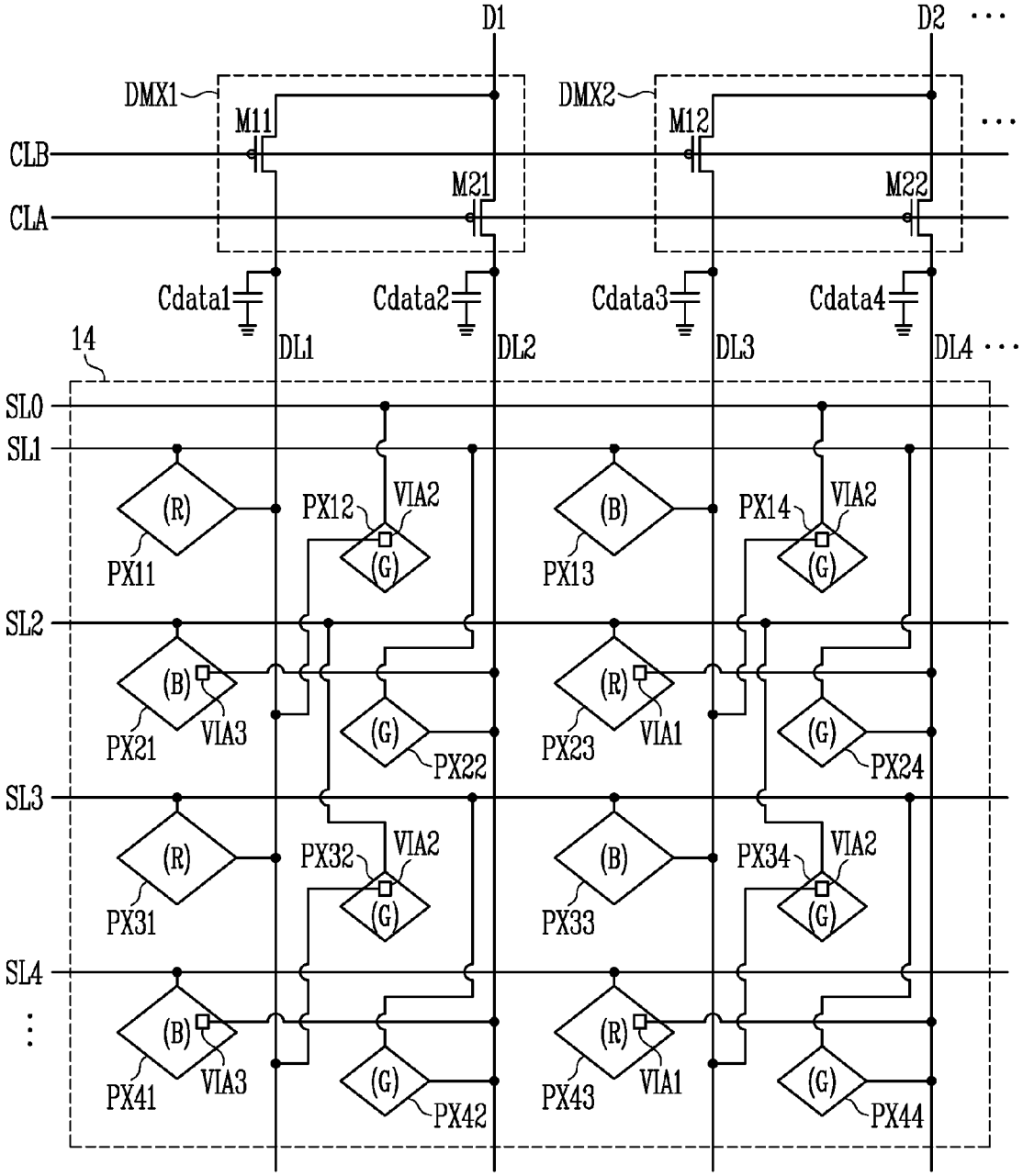
FIG. 4 is a schematic view of an example of a demultiplexer and the pixel unit, which are provided in the display device of FIG. 1.

FIG. 4 is a schematic view of an example of the demultiplexer and the pixel unit, which are provided in the display device of FIG. 1.

Referring to FIG. 4, in an embodiment, each of demultiplexers DMX1, DMX2, . . . may include a plurality of transistors.

In an embodiment, a first demultiplexer DMX1 may include a transistor M11 and a transistor M21. A second demultiplexer DMX2 may include a transistor M12 and a transistor M22.

Hereinafter, although the first demultiplexer DMX1 and the second demultiplexer DMX2 are described as an example, each demultiplexer included in the demultiplexer circuit 15 is configured substantially identically or similarly to the first demultiplexer DMX1 and the second demultiplexer DMX2, and therefore, repetitive descriptions will be omitted to avoid redundancy.

A gate electrode of the transistor M11 included in the first demultiplexer DMX1 is connected to the second control line CLB. One end of the transistor M11 is connected to a first output line D1, and the other end of the transistor M11 is connected to a first data line DL1. A first data capacitor Cdata1 may be connected to the first data line DL1.

A gate electrode of the transistor M21 included in the first demultiplexer DMX1 is connected to the first control line CLA. One end of the transistor M21 is connected to the first output line D1, and the other end of the transistor M21 is connected to a second data line DL2. A second data capacitor Cdata2 may be connected to the second data line DL2.

The transistor M11 included in the first demultiplexer DMX1 may output a first data signal to the first data line DL1 in response to a second control signal supplied to the second control line CLB. The first data signal, which is output from the first data line DL1, may be stored in the first data capacitor Cdata1.

The transistor M21 included in the first demultiplexer DMX1 may output the first data signal to the second data line DL2 in response to a first control signal supplied to the first control line CLA. The first data signal, which is output from the second data line DL2, may be stored in the second data capacitor Cdata2.

A pixel PX11 included in a first pixel column PXC1 may be connected to a first scan line SL1 and the first data line DL1. A pixel PX21 included in the first pixel column PXC1 may be connected to a second scan line SL2, and be connected to the second data line DL2 through a third opening VIA3. For example, the third opening VIA3 may include a third via hole or a third contact hole. A pixel PX31 included in the first pixel column PXC1 may be connected to a third scan line SL3 and the first data line DL1. A pixel PX41 included in the first pixel column PXC1 may be connected to a fourth scan line SL4, and be connected to the second data line DL2 through the third opening VIA3.

A pixel PX12 included in a second pixel column PXC2 may be connected to a zeroth scan line SL0, and be connected to the first data line DL1 through a second opening VIA2. For example, the second opening VIA2 may include a second via hole or a second contact hole. A pixel PX22 included in the second pixel column PXC2 may be connected to the first scan line SL1 and the second data line DL2. A pixel PX32 included in the second pixel column PXC2 may be connected to the second scan line SL2, and be connected to the first data line DL1 via the second opening VIA2. A pixel PX42 included in the second pixel column PXC2 may be connected to the third scan line SL3, and be connected to the second data line DL2.

A gate electrode of the transistor M12 included in the second demultiplexer DMX2 is connected to the second control line CLB. One end of the transistor M12 is connected to a second output line D2, and the other end of the transistor M12 is connected to a third data line DL3. A third data capacitor Cdata3 may be connected to the third data line DL3.

A gate electrode of the transistor M22 included in the second demultiplexer DMX2 is connected to the first control line CLA. One end of the transistor M22 is connected to the second output line D2, and the other end of the transistor M22 is connected to a fourth data line DL4. A fourth data capacitor Cdata4 may be connected to the fourth data line DL4.

The transistor M12 may output a second data signal to the third data line DL3 in response to the second control signal supplied to the second control line CLB. The second data signal may be store in the third data capacitor Cdata3 when the transistor M12 is turned on. The transistor M22 may output the second data signal to the fourth data line DL4 in response to the first control signal supplied to the first control line CLA. The second data signal may be stored in the fourth data capacitor Cdata4 when the transistor M22 is turned on.

A pixel PX13 included in a third pixel column PXC3 may be connected to the first scan line SL1 and the third data line DL3. A pixel PX23 included in the third pixel column PXC3 may be connected to the second scan line SL2, and be connected to the fourth data line DL4 through a first opening VIA1. For example, the first opening VIA1 may include a first via hole or a first contact hole. A pixel PX33 included in the third pixel column PXC3 may be connected to the third scan line SL3 and the third data line DL3. A pixel PX43 included in the third pixel column PXC3 may be connected to the fourth scan line SL4, and be connected to the fourth data line DL4 through the first opening VIA1.

A pixel PX14 included in a fourth pixel column PXC4 may be connected to the zeroth scan line SL0, and be connected to the third data line DL3 through a second opening VIA2. For example, the second opening VIA2 may include a second via hole or a second contact hole. A pixel PX24 included in the fourth pixel column PXC4 may be connected to the first scan line SL1 and the fourth data line DL4. A pixel PX34 included in the fourth pixel column PXC4 may be connected to the second scan line SL2, and be connected to the third data line DL3 through the second opening VIA2. A pixel PX44 included in the fourth pixel column PXC4 may be connected to the third scan line SL3 and the fourth data line DL4.

Referring to FIG. 4, the first opening VIA1 may be provided in each of the pixels PX23 and PX43, and a second transistor T2 (see FIG. 3) of each of the pixels PX23 and PX43 may be connected to the fourth data line DL4 through the first opening VIA1. The second opening VIA2 may be provided in each of the pixels PX12, PX14, PX32, and PX34 of the second pixel column PXC2 and the fourth pixel column PXC4, and a second transistor T2 of each of the pixels PX12 and PX32 may be connected to the first data line DL1 through the second opening VIA2. A second transistor T2 of each of the pixels PX14 and PX34 may be connected to the third data line DL3 through the second opening VIA2. The third opening VIA3 may be provided in each of the pixels PX21 and PX41 included in the first pixel column PXC1, and a second transistor T2 of each of the pixel PX21 and PX41 may be connected to the second data line DL2 through the third opening VIA3.

Additionally, an arrangement of pixels PX on pixel columns PXC1 and PXC2 may be described as follows.

Pixels PX11 and PX31 (e.g., first pixels), which are located on a (2j−1)-th (j is a natural number) pixel column (e.g., a (2j−1)-th column) and a (2k−1)-th (k is a positive integer) horizontal line (e.g., a (2k−1)-th row) are connected to the first data line DL1. For example, the first pixels may include a first color pixel, e.g., a red pixel.

Pixels PX21 and PX41 (e.g., second pixels) located on the (2j−1)-th pixel column (e.g., a (2j−1)-th column) and a (2k)-th horizontal line (e.g., a (2k)-th row) are connected to the second data line DL2. For example, the second pixels may include a second color pixel, e.g., a blue pixel.

Pixels PX12 and PX32 (e.g., third pixels) located on a (2j)-th pixel column (e.g., a (2j)-th column) and the (2k−1)-th horizontal line (e.g., a (2k−1)-th row) are connected to the first data line DL1. For example, the third pixels may include a third color pixel, e.g., a green pixel.

Pixels PX22 and PX42 (e.g., fourth pixels) located on the (2j)-th pixel column (e.g., a (2j)-th column) and the (2k)-th horizontal line (e.g., a (2k)-th row) are connected to the second data line DL2. For example, the fourth pixels may include the third color pixel, e.g., the green pixel.

The first pixels PX11 and PX31 emit a first color light (e.g., red light), the second pixels PX21 and PX41 emit a second color light (e.g., blue light), and the third pixels PX12 and PX32 and the fourth pixels PX22 and PX42 emit a third color light (e.g., green light).

In addition, while the first pixels PX11 and PX31 and the second pixels PX21 and PX41 are supplied with a scan signal from a scan line (e.g., any one of the first to fourth scan lines SL1 to SL4) located on a current horizontal line, the third pixels PX12 and PX32 and the fourth pixels PX22 and PX42 are supplied with a scan signal from a scan line (e.g., any one of the zeroth to third scan lines SL0 to SL3) located on a previous horizontal line. For example, while the first pixel PX11 is supplied with a first scan signal from the first scan line SL1, the third pixel PX12 is supplied with a zeroth scan signal from the zeroth scan line SL0. While the second pixel PX21 is supplied with a second scan signal from the second scan line SL2, the fourth pixel PX22 is supplied with the first scan signal from the first scan line SL1. While the first pixel PX31 is supplied with a third scan signal from the third scan line SL3, the third pixel PX32 is supplied with the second scan signal from the second scan line SL2. While the second pixel PX41 is supplied with a fourth scan signal from the fourth scan line SL4, the fourth pixel PX42 is supplied with the third scan signal from the third scan line SL3.

Pixels PX on the pixel columns PXC3 and PXC4 are similar or identical to those on the pixel columns PXC1 and PXC2, except that only the positions of the pixels PX23 and PX43 emitting the first color light (e.g., red light) and the pixels PX13 and PX33 emitting the second color light (e.g., blue light) are changed.

Figure 5A:
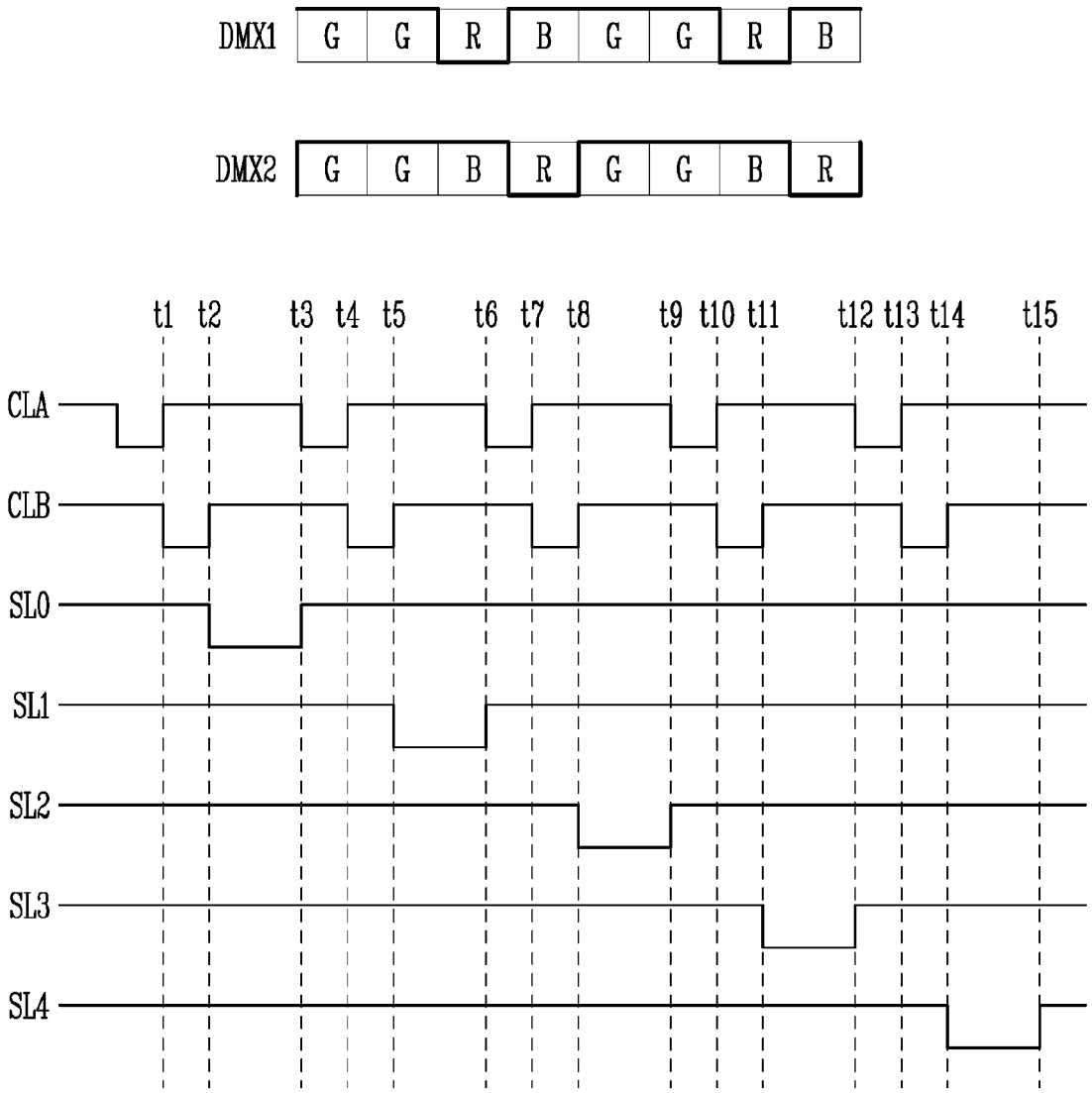
FIG. 5A is a time diagram illustrating an example of a data signal output from the demultiplexer included in the display device of FIG. 2.
Figure 5B:
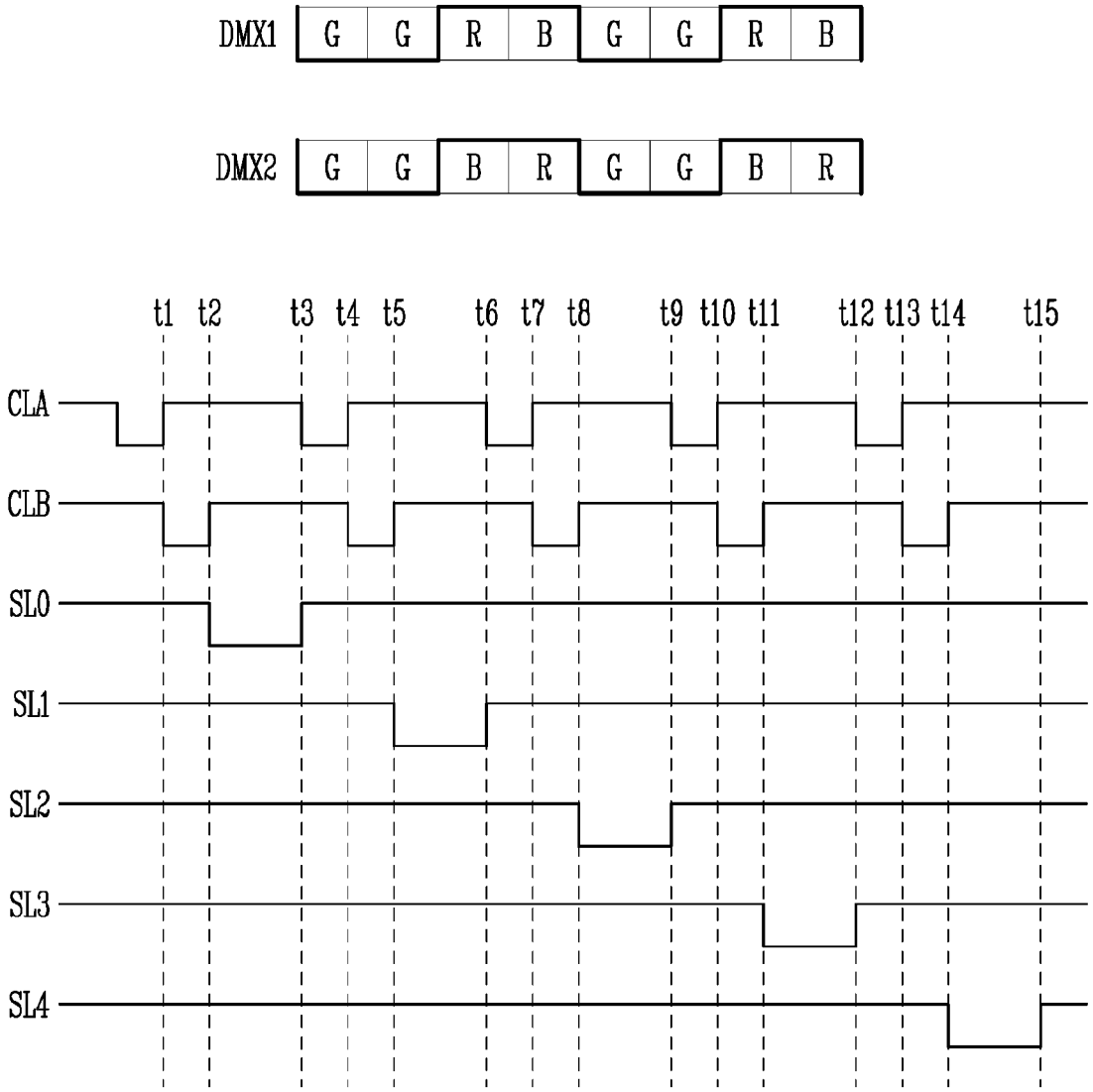
FIG. 5B is a time diagram illustrating another example of the data signal output from the demultiplexer included in the display device of FIG. 2.
Figure 5C:
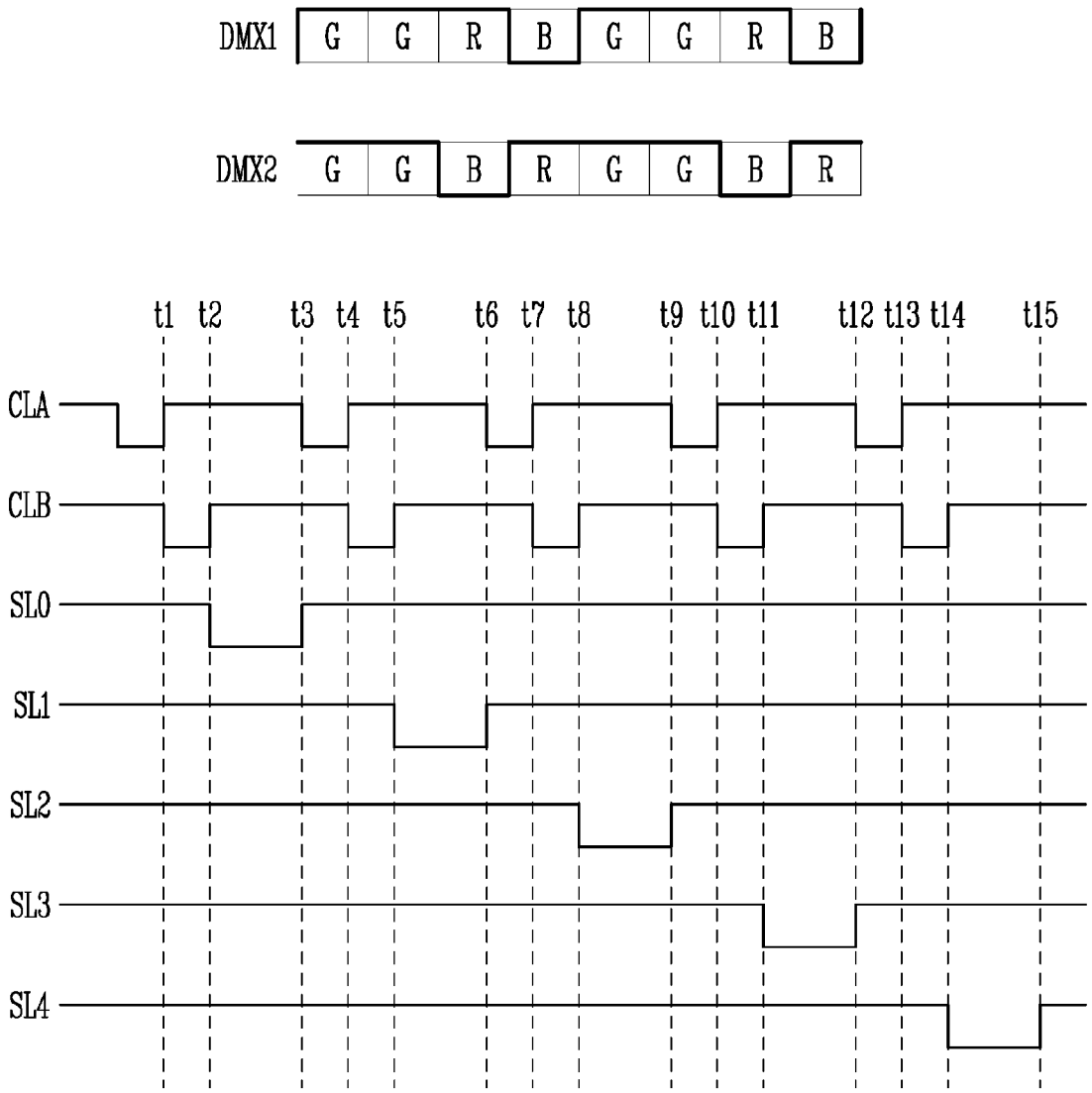
FIG. 5C is a time diagram illustrating still another example of the data signal output from the demultiplexer included in the display device of FIG. 2.

FIG. 5A is a time diagram illustrating an example of a data signal output from the demultiplexer included in the display device of FIG. 2. FIG. 5B is a time diagram illustrating another example of the data signal output from the demultiplexer included in the display device FIG. 2. FIG. 5C is a time diagram illustrating still another example of the data signal output from the demultiplexer included in the display device FIG. 2.

Hereinafter, in FIGS. 5A, 5B, and 5C, it is assumed that, after the first control signal is applied through the first control line CLA, the second control signal is applied through the second control line CLB.

Hereinafter, in FIG. 5A, it is assumed that the first data signal applied to the first and second data lines DL1 and DL2 and the second data signal applied to the third and fourth data lines DL3 and DL4 include data having a low level, at which red pixels PX11, PX31, PX23, and PX33 (R) are turned on and emit light, and include data having a high level, at which blue pixels PX21, PX41, PX13, and PX33 (B) and green pixels PX12, PX22, PX32, PX42, PX14, PX24, PX34, and PX44 (G) are turned off and do not emit light. For example, the first data signal may include a first red data signal R, a first green data signal G, and a first blue data signal B. For example, the second data signal may include a second red data signal R, a second green data signal G, and a second blue data signal B.

Referring to FIGS. 4 and 5A, when the first control signal is applied to the gate electrode of the transistor M21 through the first control line CLA, the transistor M21 is turned on. The first data signal output from the first output line D1 is stored in the second data capacitor Cdata2 connected to the second data line DL2.

When the second control signal is applied to the gate electrode of the transistor M11 through the second control line CLB, the transistor M11 is turned on. The first data signal output from the first output line D1 is stored in the first data capacitor Cdata1 connected to the first data line DL1.

Hereinafter, a driving method of the pixels PX11, PX12, PX21, PX22, PX31, PX32, PX41, and PX42 included in the first pixel column PXC1 and the second pixel column PXC2 will be described.

Specifically, a first green data signal G is supplied to the first output line D1 at a time t1 at which the second control signal is supplied through the second control line CLB. The first green data signal G is stored in the first data capacitor Cdata1 via the transistor M11 until a time t2 at which the supply of the second control signal of the second control line CLB is ended.

Subsequently, a zeroth scan signal is supplied to the zeroth scan line SL0 at the time t2, so that the pixel PX12 is selected. Then, the first green data signal G stored in the first data capacitor Cdata1 may be applied to the pixel PX12 through the second opening VIA2 connected to the first data line DL1. The pixel PX12, to which the first green data signal G having the high level is applied, may be turned off such that the pixel PX12 does not emit a green light.

After the supply of the zeroth scan signal is suspended, the first control signal and the second control signal are sequentially supplied.

The first green data signal G is supplied to the first output line D1 to be synchronized with the first control signal of the first control line CLA, and a first red data signal R is supplied to the first output line D1 to be synchronized with the second control signal of the second control line CLB.

The first green data signal G supplied to the first output line D1 at a time t3, at which the first control signal is supplied through the first control line CLA, may be stored in the second data capacitor Cdata2 via the transistor M21 until a time t4 at which the supply of the first control signal of the first control line CLA is ended.

The first red data signal R supplied to the first output line D1 at the time t4, at which the second control signal is supplied through the second control line CLB, may be stored in the first data capacitor Cdata1 via the transistor M11 until a time t5 at which the supply of the second control signal of the second control line CLB is ended.

Subsequently, when the first scan signal is applied to the first scan line SL1 at the time t5, the pixel PX22 and the pixel PX11 are selected. Then, the first green data signal G stored in the second data capacitor Cdata2 is supplied to the pixel PX22. The first red data signal R stored in the first data capacitor Cdata1 is supplied to the pixel PX11.

The pixel PX22, to which the first green data signal G having the high level is applied, may be turned off not to emit green light. The pixel PX11, to which the first red data signal R having the low level is applied, may be turned on to emit red light.

After the supply of the first scan signal is suspended, the first control signal and the second control signal are sequentially supplied.

A first blue data signal B is supplied to the first output line D1 to be synchronized with the first control signal of the first control line CLA, and the first green data signal G is supplied to the first output line D1 to be synchronized with the second control signal of the second control line CLB.

The first blue data signal B supplied to the first output line D1 at a time t6, at which the first control signal is supplied through the first control line CLA, may be stored in the second data capacitor Cdata2 via the transistor M21 until a time t7 at which the supply of the first control signal of the first control line CLA is ended.

The first green data signal G supplied to the first output line D1 at the time t7, at which the second control signal is supplied through the second control line CLB, may be stored in the first data capacitor Cdata1 via the transistor M11 until a time t8 at which the supply of the second control signal of the second control line CLB is ended.

Subsequently, when the second scan signal is applied to the second scan line SL2 at the time t8, the pixel PX21 and the pixel PX32 are selected. Then, the first blue data signal B stored in the second data capacitor Cdata2 is supplied to the pixel PX21 through the third opening VIA3 connected to the second data line DL2. In addition, the first green data signal G stored in the first data capacitor Cdata1 is supplied to the pixel PX32 via the second opening VIA2 connected to the first data line DL1.

The pixel PX21, to which the first blue data signal B having the high level is applied, may be turned off not to emit blue light. In addition, the pixel PX32, to which the first green data signal G having the high level is applied, may be turned off not to emit green light.

Since the other pixels included in the first pixel column PXC1 and the second pixel column PXC2 are also supplied with the first data signal while repeating the above-described operating process, descriptions of times t9, t10, t11, t12, t13, t14, and t15 overlap with those of the times t1, t2, t3, t4, t5, t6, t7, and t8, and therefore will be omitted for descriptive convenience.

Hereinafter, a driving method of the pixels PX13, PX14, PX23, PX24, PX33, PX34, PX43, and PX44 included in the third pixel column PXC3 and the fourth pixel column PXC4 will be described.

Specifically, a second green data signal G is supplied to the second output line D2 at the time t1 at which the second control signal is supplied through the second control line CLB. The second green data signal G is stored in the third data capacitor Cdata3 via the transistor M12 until the time t2 at which the supply of the second control signal of the second control line CLB is ended.

Subsequently, the zeroth scan signal is supplied to the zeroth scan line SL0 at the time t2, so that the pixel PX14 is selected. Then, the second green data signal G stored in the third data capacitor Cdata3 may be applied to the pixel PX14 through the second opening VIA2 connected to the third data line DL3. The pixel PX12, to which the second green data signal G having the high level is applied, may be turned off not to emit green light.

After the supply of the zeroth scan signal is suspended, the first control signal and the second control signal are sequentially supplied.

The second green data signal G is supplied to the second output line D2 to be synchronized with the first control signal of the first control line CLA, and a second blue data signal B is supplied to the second output line D2 to be synchronized with the second control signal of the second control line CLB.

The second green data signal G supplied to the second output line D2 at the time t3, at which the first control signal is supplied through the first control line CLA, may be stored in the fourth data capacitor Cdata4 via the transistor M22 until the fourth time at which the supply of the first control signal of the first control line CLA is ended.

The second blue data signal B supplied to the second output line D2 at the time t4, at which the second control signal is supplied through the second control line CLB, may be stored in the third data capacitor Cdata3 via the transistor M12 until at the time t5 at which the supply of the second control signal of the second control line CLB is ended.

Subsequently, when the first scan signal is applied to the first scan line SL1 at the time t5, the pixel Px24 and PX13 are selected. Then, the second green data signal G stored in the fourth data capacity Cdata4 is supplied to the pixel PX24, and the second blue data signal B stored in the third data capacitor Cdata3 is supplied to the pixel PX13.

The pixel PX24, to which the second green data signal G having the high level is applied, may be turned off not to emit green light. The pixel PX13, to which the second blue data signal B having the high level is applied, may be turned off not to emit blue light.

After the supply of the first scan signal is suspended, the first control signal and the second control signal are sequentially supplied.

A second red data signal R is supplied to the second output line D2 to be synchronized with the first control signal of the first control line CLA, and the second green data signal G is supplied to the second output line D2 to be synchronized with the second control signal of the second control line CLB.

The second red data signal R supplied to the second output line D2 at the time t6, at which the first control signal is supplied through the first control line CLA, may be stored in the fourth data capacitor Cdata4 via the transistor M22 until the time t7 at which the supply of the first control signal of the first control line CLA is ended.

The first green data signal G supplied to the second output line D2 at the time t7, at which the second control signal is supplied through the second control line CLB, may be stored in the third data capacitor Cdata3 via the transistor M12 until the time t8 at which the supply of the second control signal of the second control line CLB is ended.

Subsequently, when the second scan signal is applied to the second scan line SL2 at the time t8, the pixel PX23 and the pixel PX34 are selected. Then, the second red data signal R stored in the fourth data capacitor Cdata4 is supplied to the pixel PX23 through the first opening VIA1 connected to the fourth data line DL4. In addition, the second green data signal G stored in the third data capacitor Cdata3 is supplied to the pixel PX34 through the second opening VIA2 connected to the third data line DL3.

The pixel PX23, to which the second red data signal R having the low level is applied, may be turned on to emit red light. In addition, the pixel PX34, to which the second green data signal G having the high level is applied, may be turned off not to emit green light.

Since the other pixels included in the third pixel column PXC3 and the fourth pixel column PXC4 are also supplied with the second data signal while repeating the above-described operating process, descriptions of the times t9, t10, t11, t12, t13, t14, and t15 overlap with those of the times t1, t2, t3, t4, t5, t6, t7, and t8, and therefore will be omitted for descriptive convenience.

As described above, display device constructed in accordance with the principles and illustrative embodiments of the invention include a structure connected to a data line through an opening provided in a pixel. Thus, when a red image is displayed on the display panel, the number of times that a data signal output from a demultiplexer is toggled (e.g., the number of times that the turn-on and turn-off levels of the data signal output from the demultiplexer are changed) can be decreased, and power consumption can be reduced.

Hereinafter, in FIG. 5B, it is assumed that the first data signal applied to the first and second data lines DL1 and DL2 and the second data signal applied to the third and fourth data lines DL3 and DL4 includes data having a low level, at which green pixels PX12, PX22, PX32, PX42, PX14, PX24, PX34, and PX44 (G) are turned on and emit light, and include data having a high level, at which red pixels PX11, PX31, PX23, and PX43 (R) and blue pixels PX21, PX41, PX13, and PX33 (B) are turned off and do not emit light).

Referring to FIGS. 4 and 5B, when the first control signal is applied to the gate electrode of the transistor M21 through the first control line CLA, the transistor M21 is turned on. The first data signal output from the first output line D1 is stored in the second data capacitor Cdata2 connected to the second data line DL2.

When the second control signal is applied to the gate electrode of the transistor M11 through the second control line CLB, the transistor M11 is turned on. The first data signal output from the first output line D1 is stored in the first data capacitor Cdata1 connected to the first data line DL1.

Hereinafter, a driving method of the pixels PX11, PX12, PX21, PX22, PX31, PX32, PX41, and PX42 included in the first pixel column PXC1 and the second pixel column PXC2 will be described.

Specifically, a first green data signal G is supplied to the first output line D1 at a time t1 at which the second control signal is supplied through the second control line CLB. The first green data signal G is stored in the first data capacitor Cdata1 via the transistor M11 until a time t2 at which the supply of the second control signal of the second control line CLB is ended.

Subsequently, a zeroth scan signal is supplied to the zeroth scan line SL0 at the time t2, so that the pixel PX12 is selected. Then, the first green data signal G stored in the first data capacitor Cdata1 may be applied to the pixel PX12 through the second opening VIA2 connected to the first data line DL1. The pixel PX12, to which the first green data signal G having the low level is applied, may be turned on to emit green light.

After the supply of the zeroth scan signal is suspended, the first control signal and the second control signal are sequentially supplied.

The first green data signal G is supplied to the first output line D1 to be synchronized with the first control signal of the first control line CLA, and a first red data signal R is supplied to the first output line D1 to be synchronized with the second control signal of the second control line CLB.

The first green data signal G supplied to the first output line D1 at a time t3, at which the first control signal is supplied through the first control line CLA, may be stored in the second data capacitor Cdata2 via the transistor M21 until a time t4 at which the supply of the first control signal of the first control line CLA is ended.

The first red data signal R supplied to the first output line D1 at the time t4, at which the second control signal is supplied through the second control line CLB, may be stored in the first data capacitor Cdata1 via the transistor M11 until a time t5 at which the supply of the second control signal of the second control line CLB is ended.

Subsequently, when the first scan signal is applied to the first scan line SL1 at the time t5, the pixel PX22 and the pixel PX11 are selected. Then, the first green data signal G stored in the second data capacitor Cdata2 is supplied to the pixel PX22. The first red data signal R stored in the first data capacitor Cdata1 is supplied to the pixel PX11.

The pixel PX22, to which the first green data signal G having the low level is applied, may be turned on to emit green light. The pixel PX11, to which the first red data signal R having the high level is applied, may be turned off not to emit red light.

After the supply of the first scan signal is suspended, the first control signal and the second control signal are sequentially supplied.

A first blue data signal B is supplied to the first output line D1 to be synchronized with the first control signal of the first control line CLA, and the first green data signal G is supplied to the first output line D1 to be synchronized with the second control signal of the second control line CLB.

The first blue data signal B supplied to the first output line D1 at a time t6, at which the first control signal is supplied through the first control line CLA, may be stored in the second data capacitor Cdata2 via the transistor M21 until a time t7 at which the supply of the first control signal of the first control line CLA is ended.

The first green data signal G supplied to the first output line D1 at the time t7, at which the second control signal is supplied through the second control line CLB, may be stored in the first data capacitor Cdata1 via the transistor M11 until a time t8 at which the supply of the second control signal of the second control line CLB is ended.

Subsequently, when the second scan signal is applied to the second scan line SL2 at the time t8, the pixel PX21 and the pixel PX32 are selected. Then, the first blue data signal B stored in the second data capacitor Cdata2 is supplied to the pixel PX21 through the third opening VIA3 connected to the second data line DL2. In addition, the first green data signal G stored in the first data capacitor Cdata1 is supplied to the pixel PX32 via the second opening VIA2 connected to the first data line DL1.

The pixel PX21, to which the first blue data signal B having the high level is applied, may be turned off not to emit blue light. In addition, the pixel PX32, to which the first green data signal G having the low level is applied, may be turned on to emit green light.

The other pixels included in the first pixel column PXC1 and the second pixel column PXC2 are also supplied with the first data signal while repeating the above-described operating process.

Hereinafter, a driving method of the pixels PX13, PX14, PX23, PX24, PX33, PX34, PX43, and PX44 included in the third pixel column PXC3 and the fourth pixel column PXC4 will be described.

Specifically, a second green data signal G is supplied to the second output line D2 at the time t1 at which the second control signal is supplied through the second control line CLB. The second green data signal G is stored in the third data capacitor Cdata3 via the transistor M12 until the time t2 at which the supply of the second control signal of the second control line CLB is ended.

Subsequently, the zeroth scan signal is supplied to the zeroth scan line SL0 at the time t2, so that the pixel PX14 is selected. Then, the second green data signal G stored in the third data capacitor Cdata3 may be applied to the pixel PX14 through the second opening VIA2 connected to the third data line DL3. The pixel PX12, to which the second green data signal G having the low level is applied, may be turned on to emit green light.

After the supply of the zeroth scan signal is suspended, the first control signal and the second control signal are sequentially supplied.

The second green data signal G is supplied to the second output line D2 to be synchronized with the first control signal of the first control line CLA, and a second blue data signal B is supplied to the second output line D2 to be synchronized with the second control signal of the second control line CLB.

The second green data signal G supplied to the second output line D2 at the time t3, at which the first control signal is supplied through the first control line CLA, may be stored in the fourth data capacitor Cdata4 via the transistor M22 until the fourth time at which the supply of the first control signal of the first control line CLA is ended.

The second blue data signal B supplied to the second output line D2 at the time t4, at which the second control signal is supplied through the second control line CLB, may be stored in the third data capacitor Cdata3 via the transistor M12 until at the time t5 at which the supply of the second control signal of the second control line CLB is ended.

Subsequently, when the first scan signal is applied to the first scan line SL1 at the time t5, the pixel Px24 and PX13 are selected. Then, the second green data signal G stored in the fourth data capacity Cdata4 is supplied to the pixel PX24, and the second blue data signal B stored in the third data capacitor Cdata3 is supplied to the pixel PX13.

The pixel PX24, to which the second green data signal G having the low level is applied, may be turned on to emit green light. The pixel PX13, to which the second blue data signal B having the high level is applied, may be turned off not to emit blue light.

After the supply of the first scan signal is suspended, the first control signal and the second control signal are sequentially supplied.

A second red data signal R is supplied to the second output line D2 to be synchronized with the first control signal of the first control line CLA, and the second green data signal G is supplied to the second output line D2 to be synchronized with the second control signal of the second control line CLB.

The second red data signal R supplied to the second output line D2 at the time t6, at which the first control signal is supplied through the first control line CLA, may be stored in the fourth data capacitor Cdata4 via the transistor M22 until the time t7 at which the supply of the first control signal of the first control line CLA is ended.

The first green data signal G supplied to the second output line D2 at the time t7, at which the second control signal is supplied through the second control line CLB, may be stored in the third data capacitor Cdata3 via the transistor M12 until the time t8 at which the supply of the second control signal of the second control line CLB is ended.

Subsequently, when the second scan signal is applied to the second scan line SL2 at the time t8, the pixel PX23 and the pixel PX34 are selected. Then, the second red data signal R stored in the fourth data capacitor Cdata4 is supplied to the pixel PX23 through the first opening VIA1 connected to the fourth data line DL4. In addition, the second green data signal G stored in the third data capacitor Cdata3 is supplied to the pixel PX34 through the second opening VIA2 connected to the third data line DL3.

The pixel PX23, to which the second red data signal R having the high level is applied, may be turned off not to emit red light. In addition, the pixel PX34, to which the second green data signal G having the low level is applied, may be turned on to emit green light.

The other pixels included in the third pixel column PXC3 and the fourth pixel column PXC4 are also supplied with the second data signal while repeating the above-described operating process.

As described above, display devices constructed in accordance with the principles and illustrative embodiments of the invention may include a structure connected to a data line through an opening provided in a pixel. Thus, when a green image is displayed on the display panel, the number of times that a data signal output from a demultiplexer is toggled (e.g., the number of times that the turn-on and turn-off levels of the data signal output from the demultiplexer are changed) can be decreased, and power consumption can be reduced.

Hereinafter, in FIG. 5C, it is assumed that the first data signal applied to the first and second data lines DL1 and DL2 and the second data signal applied to the third and fourth data lines DL3 and DL4 includes data having a low level, at which blue pixels are turned on and emit light, and include data having a high level, at which red pixels and green pixels are turned off and do not emit light.

Referring to FIGS. 4 and 5C, when the first control signal is applied to the gate electrode of the transistor M21 through the first control line CLA, the transistor M21 is turned on. The first data signal output from the first output line D1 is stored in the second data capacitor Cdata2 connected to the second data line DL2.

When the second control signal is applied to the gate electrode of the transistor M11 through the second control line CLB, the transistor M11 is turned on. The first data signal output from the first output line D1 is stored in the first data capacitor Cdata1 connected to the first data line DL1.

Hereinafter, a driving method of the pixels PX11, PX12, PX21, PX22, PX31, PX32, PX41, and PX42 included in the first pixel column PXC1 and the second pixel column PXC2 will be described.

Specifically, a first green data signal G is supplied to the first output line D1 at a time t1 at which the second control signal is supplied through the second control line CLB. The first green data signal G is stored in the first data capacitor Cdata1 via the transistor M11 until a time t2 at which the supply of the second control signal of the second control line CLB is ended.

Subsequently, a zeroth scan signal is supplied to the zeroth scan line SL0 at the time t2, so that the pixel PX12 is selected. Then, the first green data signal G stored in the first data capacitor Cdata1 may be applied to the pixel PX12 through the second opening VIA2 connected to the first data line DL1. The pixel PX12, to which the first green data signal G having the high level is applied, may be turned off not to emit green light.

After the supply of the zeroth scan signal is suspended, the first control signal and the second control signal are sequentially supplied.

The first green data signal G is supplied to the first output line D1 to be synchronized with the first control signal of the first control line CLA, and a first red data signal R is supplied to the first output line D1 to be synchronized with the second control signal of the second control line CLB.

The first green data signal G supplied to the first output line D1 at a time t3, at which the first control signal is supplied through the first control line CLA, may be stored in the second data capacitor Cdata2 via the transistor M21 until a time t4 at which the supply of the first control signal of the first control line CLA is ended.

The first red data signal R supplied to the first output line D1 at the time t4, at which the second control signal is supplied through the second control line CLB, may be stored in the first data capacitor Cdata1 via the transistor M11 until a time t5 at which the supply of the second control signal of the second control line CLB is ended.

Subsequently, when the first scan signal is applied to the first scan line SL1 at the time t5, the pixel PX22 and the pixel PX11 are selected. Then, the first green data signal G stored in the second data capacitor Cdata2 is supplied to the pixel PX22. The first red data signal R stored in the first data capacitor Cdata1 is supplied to the pixel PX11.

The pixel PX22, to which the first green data signal G having the high level is applied, may be turned off not to emit green light. The pixel PX11, to which the first red data signal R having the high level is applied, may be turned off not to emit red light.

After the supply of the first scan signal is suspended, the first control signal and the second control signal are sequentially supplied.

A first blue data signal B is supplied to the first output line D1 to be synchronized with the first control signal of the first control line CLA, and the first green data signal G is supplied to the first output line D1 to be synchronized with the second control signal of the second control line CLB.

The first blue data signal B supplied to the first output line D1 at a time t6, at which the first control signal is supplied through the first control line CLA, may be stored in the second data capacitor Cdata2 via the transistor M21 until a time t7 at which the supply of the first control signal of the first control line CLA is ended.

The first green data signal G supplied to the first output line D1 at the time t7, at which the second control signal is supplied through the second control line CLB, may be stored in the first data capacitor Cdata1 via the transistor M11 until a time t8 at which the supply of the second control signal of the second control line CLB is ended.

Subsequently, when the second scan signal is applied to the second scan line SL2 at the time t8, the pixel PX21 and the pixel PX32 are selected. Then, the first blue data signal B stored in the second data capacitor Cdata2 is supplied to the pixel PX21 through the third opening VIA3 connected to the second data line DL2. In addition, the first green data signal G stored in the first data capacitor Cdata1 is supplied to the pixel PX32 via the second opening VIA2 connected to the first data line DL1.

The pixel PX21, to which the first blue data signal B having the low level is applied, may be turned on to emit blue light. In addition, the pixel PX32, to which the first green data signal G having the high level is applied, may be turned off not to emit green light.

The other pixels included in the first pixel column PXC1 and the second pixel column PXC2 are also supplied with the first data signal while repeating the above-described operating process.

Hereinafter, a driving method of the pixels PX13, PX14, PX23, PX24, PX33, PX34, PX43, and PX44 included in the third pixel column PXC3 and the fourth pixel column PXC4 will be described.

Specifically, a second green data signal G is supplied to the second output line D2 at the time t1 at which the second control signal is supplied through the second control line CLB. The second green data signal G is stored in the third data capacitor Cdata3 via the transistor M12 until the time t2 at which the supply of the second control signal of the second control line CLB is ended.

Subsequently, the zeroth scan signal is supplied to the zeroth scan line SL0 at the time t2, so that the pixel PX14 is selected. Then, the second green data signal G stored in the third data capacitor Cdata3 may be applied to the pixel PX14 through the second opening VIA2 connected to the third data line DL3. The pixel PX12, to which the second green data signal G having the high level is applied, may be turned off not to emit green light.

After the supply of the zeroth scan signal is suspended, the first control signal and the second control signal are sequentially supplied.

The second green data signal G is supplied to the second output line D2 to be synchronized with the first control signal of the first control line CLA, and a second blue data signal B is supplied to the second output line D2 to be synchronized with the second control signal of the second control line CLB.

The second green data signal G supplied to the second output line D2 at the time t3, at which the first control signal is supplied through the first control line CLA, may be stored in the fourth data capacitor Cdata4 via the transistor M22 until the fourth time at which the supply of the first control signal of the first control line CLA is ended.

The second blue data signal B supplied to the second output line D2 at the time t4, at which the second control signal is supplied through the second control line CLB, may be stored in the third data capacitor Cdata3 via the transistor M12 until at the time t5 at which the supply of the second control signal of the second control line CLB is ended.

Subsequently, when the first scan signal is applied to the first scan line SL1 at the time t5, the pixel Px24 and PX13 are selected. Then, the second green data signal G stored in the fourth data capacity Cdata4 is supplied to the pixel PX24, and the second blue data signal B stored in the third data capacitor Cdata3 is supplied to the pixel PX13.

The pixel PX24, to which the second green data signal G having the high level is applied, may be turned off not to emit green light. The pixel PX13, to which the second blue data signal B having the low level is applied, may be turned on to emit blue light.

After the supply of the first scan signal is suspended, the first control signal and the second control signal are sequentially supplied.

A second red data signal R is supplied to the second output line D2 to be synchronized with the first control signal of the first control line CLA, and the second green data signal G is supplied to the second output line D2 to be synchronized with the second control signal of the second control line CLB.

The second red data signal R supplied to the second output line D2 at the time t6, at which the first control signal is supplied through the first control line CLA, may be stored in the fourth data capacitor Cdata4 via the transistor M22 until the time t7 at which the supply of the first control signal of the first control line CLA is ended.

The first green data signal G supplied to the second output line D2 at the time t7, at which the second control signal is supplied through the second control line CLB, may be stored in the third data capacitor Cdata3 via the transistor M12 until the time t8 at which the supply of the second control signal of the second control line CLB is ended.

Subsequently, when the second scan signal is applied to the second scan line SL2 at the time t8, the pixel PX23 and the pixel PX34 are selected. Then, the second red data signal R stored in the fourth data capacitor Cdata4 is supplied to the pixel PX23 through the first opening VIA1 connected to the fourth data line DL4. In addition, the second green data signal G stored in the third data capacitor Cdata3 is supplied to the pixel PX34 through the second opening VIA2 connected to the third data line DL3.

The pixel PX23, to which the second red data signal R having the high level is applied, may be turned off not to emit red light. In addition, the pixel PX34, to which the second green data signal G having the high level is applied, may be turned off not to emit green light.

The other pixels included in the third pixel column PXC3 and the fourth pixel column PXC4 are also supplied with the second data signal while repeating the above-described operating process.

As described above, display devices constructed in accordance with the principles and illustrative embodiments of the invention may include a structure connected to a data line through an opening provided in a pixel. Thus, when a blue image is displayed on the display panel, the number of times that a data signal output from a demultiplexer is toggled (e.g., the number of times that the turn-on and turn-off levels of the data signal output from the demultiplexer are changed) can be decreased, and power consumption can be reduced.

Figure 6:
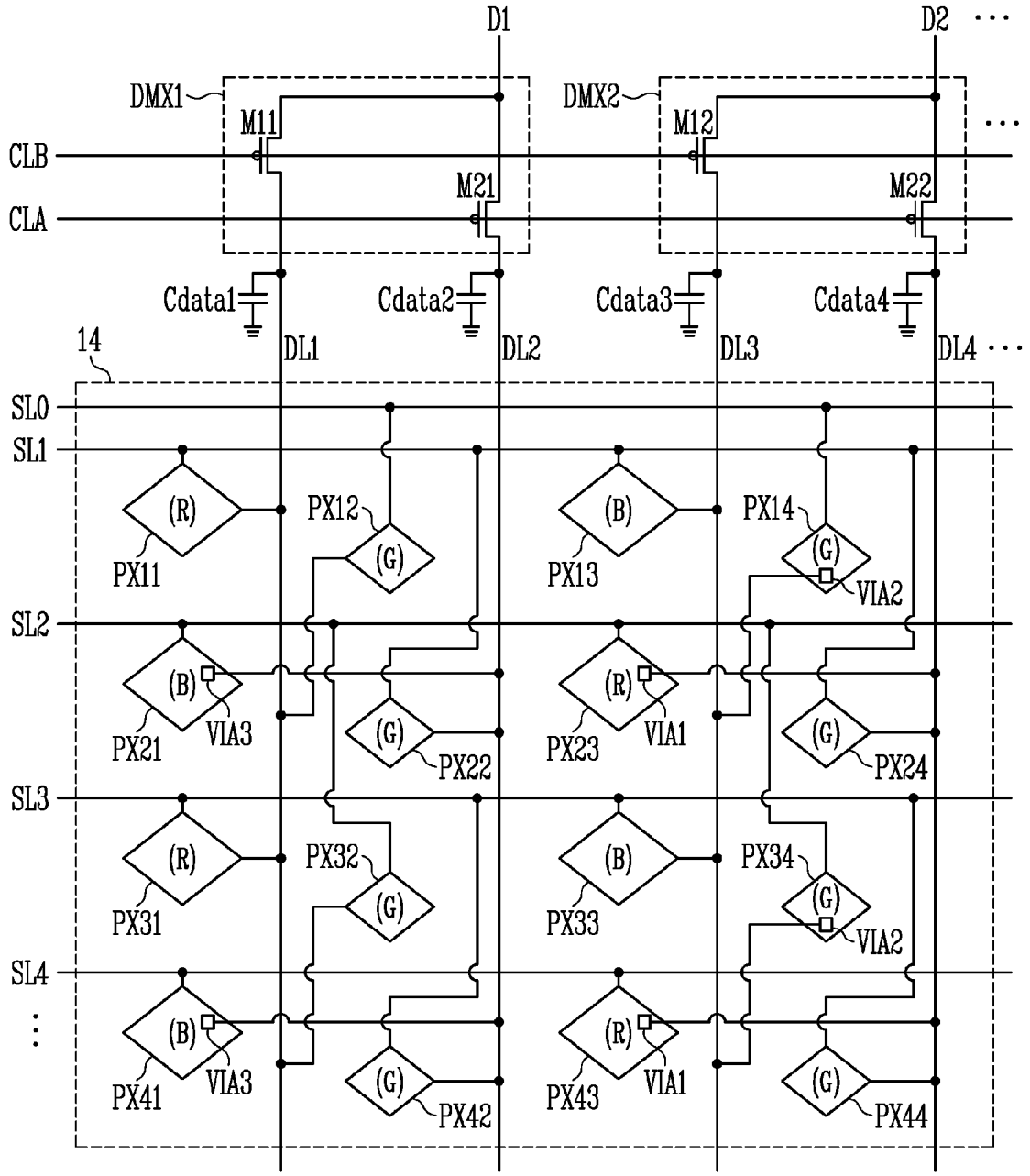
FIG. 6 is a schematic view of another example of the demultiplexer and the pixel unit, which are provided in the display device of FIG. 1.
Figure 7:
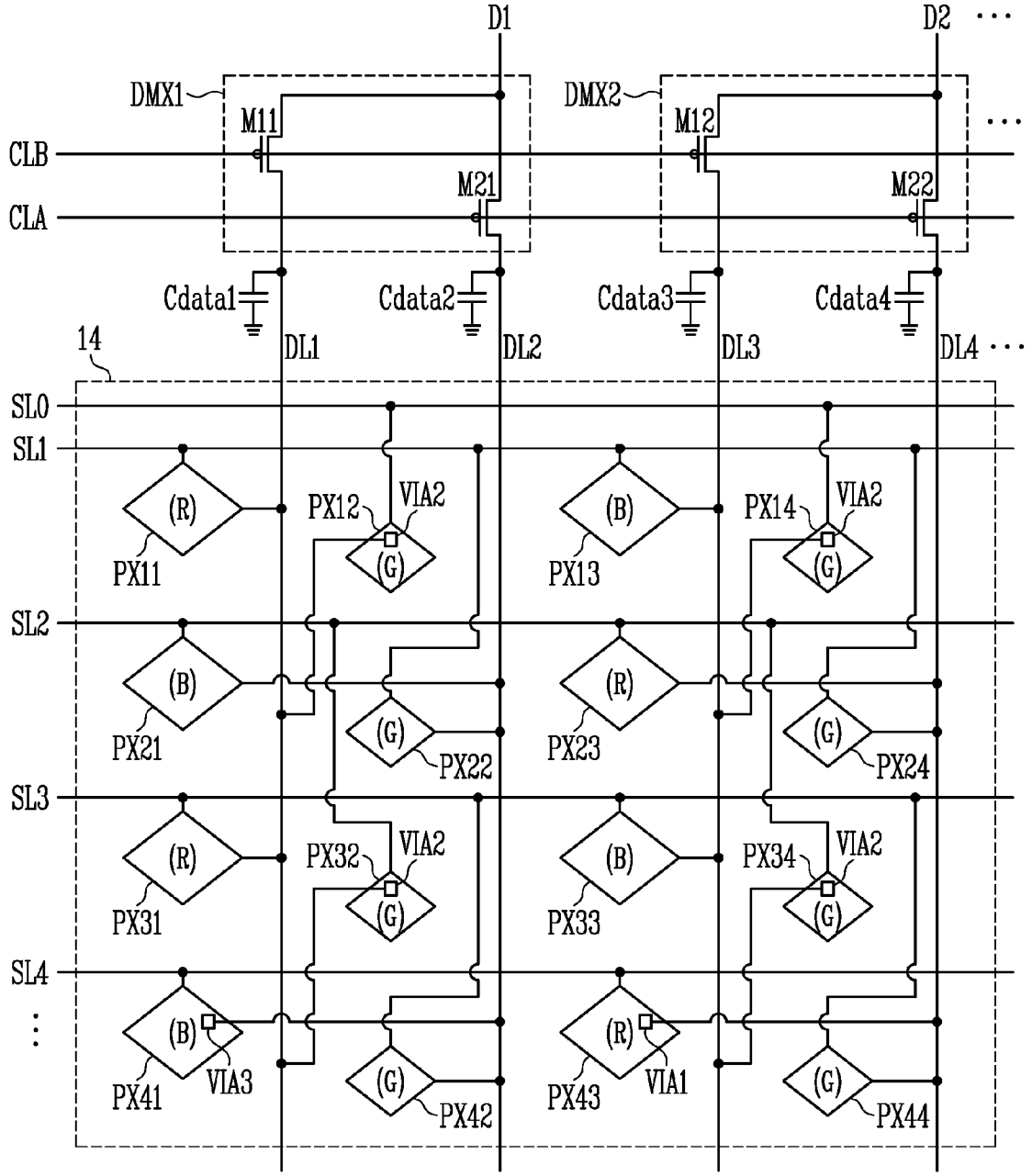
FIG. 7 is a schematic view of another example of the demultiplexer and the pixel unit, which are provided in the display device of FIG. 1.
Figure 8:
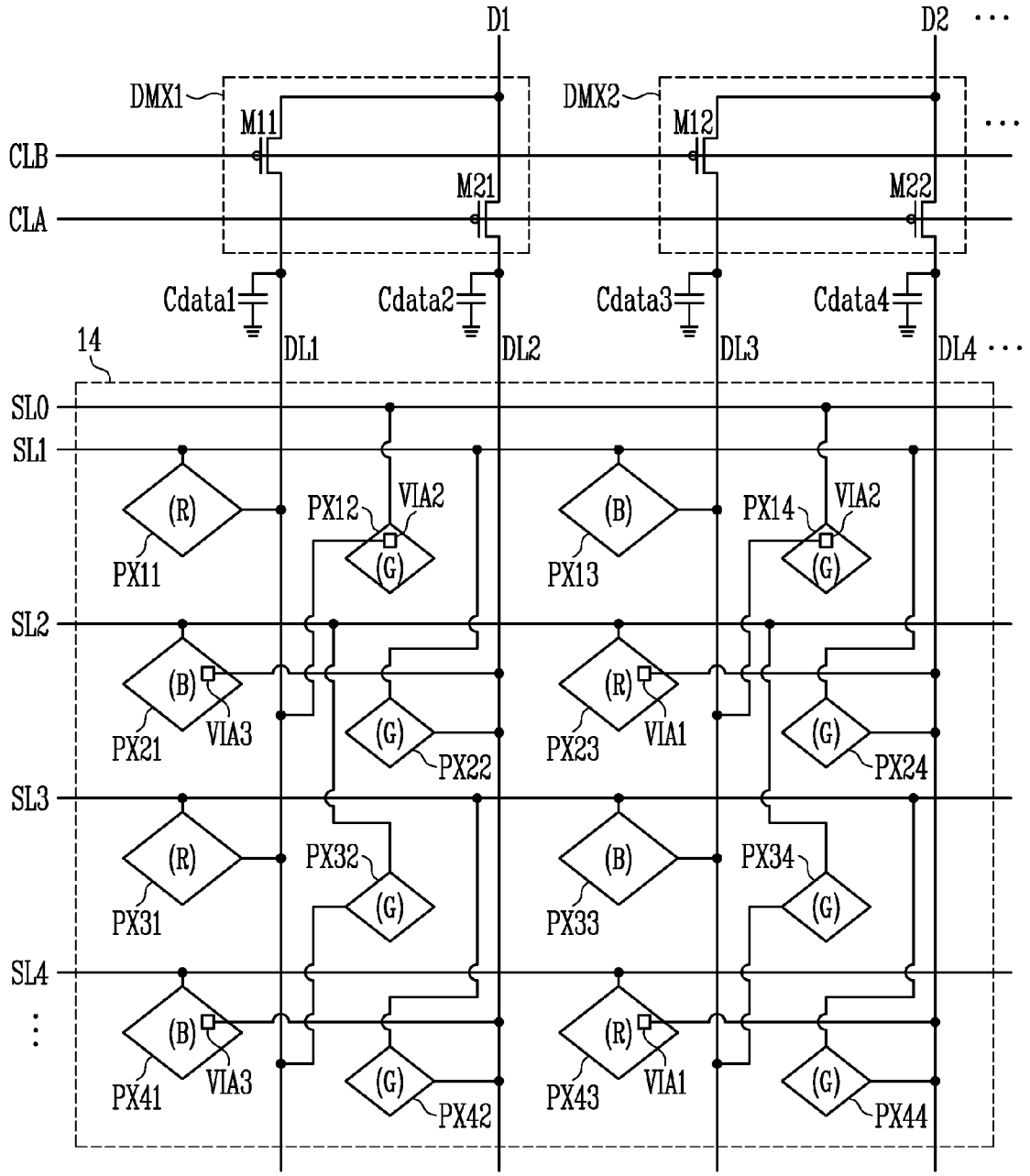
FIG. 8 is a schematic view of another example of the demultiplexer and the pixel unit, which are provided in the display device of FIG. 1.

FIG. 6 is a schematic view illustrating an example of the demultiplexer and the pixel unit, which are provided in the display device of FIG. 1. FIG. 7 is a schematic view illustrating an example of the demultiplexer and the pixel unit, which are provided in the display device of FIG. 1. FIG. 8 is a schematic view illustrating an example of the demultiplexer and the pixel unit, which are provided in the display device of FIG. 1.

As described with reference to FIG. 4, a case where the pixels PX21 and PX41 are connected to the second data line DL2 via the third opening VIA3 and the pixels PX12 and PX32 are connected to the first data line DL1 via the second opening VIA2 has been described in FIG. 4. However, embodiments are not limited thereto.

In an example, in the display panel PNL, a scan line, a data line, a power line, and the like are formed while a plurality of conductors are located in different layers. Therefore, openings may be added or removed corresponding to the structure (e.g., section) of layers constituting the display panel PNL.

In example, as shown in FIG. 6, the pixels PX12 and PX32 may be directly connected to the first data line DL1 without passing through the second opening VIA2. In addition, as shown in FIG. 7, the pixels PX21 and PX23 may be directly connected respectively to the second data line DL2 and the fourth data line DL4 without passing through the third opening VIA3.

In addition, as shown in FIG. 8, the pixels PX32 and PX24 may be directly connected respectively to the first data line DL1 and the third data line DL3 without passing through the second opening VIA2.

Display devices and the methods of driving the same made in accordance with the principles and illustrative embodiments of the invention, change the connection relationship between pixels and data lines disposed in the display panel, e.g., by using one or more multiplexers, to reduce power consumption.

Although certain embodiments and implementations have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. A display device comprising:

a data driver to supply a data signal to output lines;

a demultiplexer connected to each of the output lines, the demultiplexer to supply the data signal supplied to each output line to a first data line and a second data line;

first pixels disposed in a (2j−1)-th column and a (2k−1)-th row, the first pixels being connected to the first data line (DL2*p*−1), wherein j, p and k are positive integers;

second pixels disposed in the (2j−1)-th column and a (2k)-th row, the second pixels being connected to the second data line (DL2*p*);

third pixels disposed in a (2j)-th column and the (2k−1)-th row, the third pixels being connected to the first data line (DL2*p*−1); and fourth pixels disposed in the (2j)-th column and the (2k)-th row, the fourth pixels being connected to the second data line (DL2*p*), wherein the first pixels are supplied with the data signal when a scan signal is supplied to a (2k−1)-th scan line, and the third pixels are supplied with the data signal when a scan signal is supplied to a (2k−2)-th scan line.

2. The display device of claim 1, wherein the second pixels are supplied with the data signal when a scan signal is supplied to a (2k)-th scan line, and the fourth pixels are supplied with the data signal when a scan signal is supplied to the (2k−1)-th scan line.

3. The display device of claim 1, wherein the demultiplexer comprises:

a first transistor connected between the output line and the first data line; and a second transistor connected between the output line and the second data line.

4. The display device of claim 3, further comprising a timing controller to supply a second control signal to the first transistor and supply a first control signal to the second transistor.

5. The display device of claim 4, wherein the timing controller supplies the first control signal and the second control signal such that the second transistor and the first transistor are sequentially turned on.

6. The display device of claim 1, wherein the first pixels emit a first color light, the second pixels emit a second color light, and the third pixels and the fourth pixels emit a third color light.

7. The display device of claim 1, wherein:

the first pixels are directly connected to the first data line, and the third pixels are connected to the first data line via a second opening.

8. The display device of claim 7, wherein:

the second pixels are connected to the second data line via a third opening, and the fourth pixels are directly connected to the second data line.

9. The display device of claim 1, wherein the first pixels and the third pixels are directly connected to the first data line.

10. The display device of claim 9, wherein:

the second pixels are connected to the second data line via a third opening, and the fourth pixels are directly connected to the second data line.

11. The display device of claim 1, wherein the second pixels and the fourth pixels are directly connected to the second data line.

12. The display device of claim 1, wherein:

the first pixels are directly connected to the first data line, and at least one of the third pixels is directly connected to the first data line, and at least one of the third pixels is connected to the first data line via a second opening.

13. A method of driving a display device including a data driver, a demultiplexer, first pixels, second pixels, third pixels, and fourth pixels, wherein the first pixels are disposed in a (2j−1)-th column and a (2k−1)-th row, and connected to a first data line (DL2*p*−1), wherein j, p and k are positive integers, the second pixels are disposed in the (2j−1)-th column and a (2k)-th row, and are connected to a second data line (DL2*p*), the third pixels are disposed in a (2j)-th column and the (2k−1)-th row, and are connected to the first data line (DL2*p*−1), and the fourth pixels are disposed in the (2j)-th column and the (2k)-th row, and are connected to the second data line (DL2*p*), the method comprising the steps of:

supplying a data signal to output lines; and supplying the data signal supplied to the output line to the first data line and the second data line, wherein:

the first pixels are supplied with the data signal when a scan signal is supplied to a (2k−1)-th scan line, and the third pixels are supplied with the data signal when a scan signal is supplied to a (2k−2)-th scan line.

14. The method of claim 13, wherein:

the second pixels are supplied with the data signal when a scan signal is supplied to a (2k)-th scan line, and the fourth pixels are supplied with the data signal when a scan signal is supplied to the (2k−1)-th scan line.

15. The method of claim 13, wherein:

the step of supplying the data signal to output the lines is performed by the data driver; and the step of supplying the data signal supplied to the output line to the first data line and the second data line is performed by the demultiplexer connected to each of the output lines.

* * * * *